US008807532B2

(12) United States Patent
Horwath et al.

(10) Patent No.: US 8,807,532 B2
(45) Date of Patent: Aug. 19, 2014

(54) LIFTING BRACKET ASSEMBLY INCLUDING JACK SCREW CONNECTOR

(75) Inventors: William A. Horwath, Tinley Park, IL (US); Thomas J. Fairbairn, Dyer, IN (US); Edwin D. Slota, Homer Glen, IL (US)

(73) Assignee: Whiting Corporation, Monee, IL (US)

( * ) Notice: Subject to any disclaimer, the term of this patent is extended or adjusted under 35 U.S.C. 154(b) by 5 days.

(21) Appl. No.: 13/251,575

(22) Filed: Oct. 3, 2011

(65) Prior Publication Data

US 2012/0193590 A1 Aug. 2, 2012

Related U.S. Application Data

(60) Provisional application No. 61/389,970, filed on Oct. 5, 2010.

(51) Int. Cl.

| | |
|---|---|
| ***B60P 1/10*** | (2006.01) |
| ***B66F 3/08*** | (2006.01) |
| ***B66F 7/12*** | (2006.01) |
| ***B23Q 3/18*** | (2006.01) |
| ***B66F 3/00*** | (2006.01) |
| *B66F 7/14* | (2006.01) |

(52) U.S. Cl.

CPC ..... *B66F 7/14* (2013.01)
USPC ..... 254/92; 254/89 H; 254/7 C; 269/63; 187/203

(58) Field of Classification Search

USPC ..... 254/92, 89 H, 7 C; 269/63; 187/203, 187/267, 219, 244
See application file for complete search history.

(56) References Cited

U.S. PATENT DOCUMENTS

| | | | | | |
|---|---|---|---|---|---|
| 943,827 | A | * | 12/1909 | Hennesy | 5/606 |
| 1,185,199 | A | * | 5/1916 | Hauer | 464/119 |
| 1,522,967 | A | | 1/1925 | Meyer et al. | |
| 1,993,245 | A | * | 3/1935 | Meron | 187/244 |
| 2,587,324 | A | * | 2/1952 | Hursh et al. | 104/12 |

(Continued)

FOREIGN PATENT DOCUMENTS

| | | |
|---|---|---|
| DE | 201 14 190 U1 | 2/2002 |
| FR | 2 584 695 | 1/1987 |
| WO | WO 96/18567 | 6/1996 |

OTHER PUBLICATIONS

International Preliminary Report on Patentability from Corresponding International Application No. PCT/US2011/054557, dated Oct. 18, 2012, 10 pages.

*Primary Examiner* — Lee D Wilson
*Assistant Examiner* — Alvin Grant
(74) *Attorney, Agent, or Firm* — Brinks Gilson & Lione

(57) ABSTRACT

A lifting bracket assembly is disclosed. The lifting bracket assembly includes a motor, a pair of gear heads mechanically coupled to the motor such that each of the gear heads is coupled to a jack screw connector, a first and second jack screw, wherein each of the jack screws is coupled to one of the jack screw connectors and one of the gear heads, a first lifting bracket rotatably coupled to the first jack screw, a second lifting bracket rotatably coupled to the second jack screw, wherein the first and second jacks screws are different, a first guide tube fixedly coupled at a first end to the first lifting bracket and coupled to a first rail beam at a second end, and a second guide tube fixedly coupled at a first end to the second lifting bracket and coupled to a second rail beam at a second end.

16 Claims, 9 Drawing Sheets

(56) References Cited

U.S. PATENT DOCUMENTS

| | | | | | |
|---|---|---|---|---|---|
| 2,593,635 | A | * | 4/1952 | Walker | 187/219 |
| RE23,687 | E | * | 7/1953 | Hursh et al. | 104/12 |
| 2,798,303 | A | * | 7/1957 | Sunnen, Jr | 34/573 |
| 2,931,448 | A | * | 4/1960 | Boutwell | 180/202 |
| 2,959,395 | A | * | 11/1960 | Strack et al. | 254/419 |
| 3,061,126 | A | * | 10/1962 | Robinson | 414/634 |
| 3,131,631 | A | * | 5/1964 | Haskin, Jr | 101/152 |
| 3,279,425 | A | * | 10/1966 | Gottscho | 118/202 |
| 3,309,060 | A | * | 3/1967 | Villars | 254/7 C |
| 3,416,438 | A | * | 12/1968 | Drace et al. | 100/218 |
| 3,449,781 | A | * | 6/1969 | French et al. | 15/77 |
| 3,687,234 | A | * | 8/1972 | Gendreau | 187/267 |
| 4,031,982 | A | * | 6/1977 | Lindfors | 29/281.5 |
| 4,050,673 | A | * | 9/1977 | Nishimura | 254/89 H |
| 4,067,543 | A | * | 1/1978 | Orth et al. | 254/425 |
| 4,196,887 | A | * | 4/1980 | Tsujimura | 254/89 H |
| 4,272,972 | A | * | 6/1981 | James | 464/119 |
| 4,830,069 | A | * | 5/1989 | Milyard | 144/48.3 |
| 4,834,409 | A | * | 5/1989 | Kramer | 180/209 |
| 5,372,339 | A | * | 12/1994 | Morgan | 244/118.5 |
| 5,513,538 | A | * | 5/1996 | Baker et al. | 73/865.6 |
| 5,535,637 | A | * | 7/1996 | Baker et al. | 73/865.6 |
| 5,637,812 | A | * | 6/1997 | Baker et al. | 73/865.6 |
| 5,920,158 | A | * | 7/1999 | Miller et al. | 318/4 |
| 6,726,435 | B1 | * | 4/2004 | Williams et al. | 414/542 |
| 7,131,800 | B2 | * | 11/2006 | Anderson et al. | 409/132 |
| 7,503,744 | B1 | * | 3/2009 | Broome | 415/3.1 |
| 8,052,125 | B2 | * | 11/2011 | Garceau | 254/418 |
| 2007/0200881 | A1 | * | 8/2007 | Park et al. | 347/8 |
| 2008/0044269 | A1 | * | 2/2008 | Pradenas | 414/462 |
| 2008/0223805 | A1 | * | 9/2008 | Lichinchi | 212/175 |
| 2009/0170615 | A1 | * | 7/2009 | Horwath et al. | 464/136 |
| 2011/0094830 | A1 | * | 4/2011 | Lund et al. | 187/203 |

* cited by examiner

LIFTING BRACKET ASSEMBLY INCLUDING JACK SCREW CONNECTOR

CROSS-REFERENCE TO RELATED APPLICATIONS

The present patent document claims the benefit of the filing date under 35U.S.C. §119(e) of Provisional U.S. Patent Application Ser. No. 61/389,970, filed Oct. 5, 2010, which is hereby incorporated by reference, and is related to U.S. utility patent application Ser. No. 12/345,151, titled "JACK SCREW CONNECTOR," filed on Dec. 29, 2008, the entire contents of which is hereby incorporated by reference.

TECHNICAL FIELD

This patent relates to car hoist systems and more particularly to a lifting bracket assembly and jack screw connector for use in a shallow pit car hoist system.

BACKGROUND

Car hoist systems may be designed or configured to include a wide selection of synchronized mechanical screw lift components, gear ratios, controls and power options. A typical car hoist system may be designed and configured to accommodate a variety of car types such as, for example, single units, married pairs and/or articulated cars. To accommodate and support the desired variety of car types, the car hoist system and components of the car hoist system can be adapted or arranged to support a wide range of lift heights, vehicle weights and dimensions.

Shallow pit car hoist systems are one type of car hoist system that may be utilized. A typical shallow pit car hoist system may operate and lift a vehicle with a pit depth of only three and a half feet (3'6"). The limited pit depth reduces excavation, construction and installation costs when compared to alternate deep pit designs, Moreover, the maintenance of the shallow pit car hoist system may be simplified when compared to alternate deep pit designs because the lifting screws may be housed in an oil-filled caisson that provides continuous oil bath lubrication to the screw and nut. This configuration protects the screw from environmental contamination and continuously lubricates the lifting screws thereby increasing the wear life of the nut and screw.

It would be desirable to provide a lifting bracket assembly and jack screw connector that may connect the lifting screws and drive mechanisms while allowing and/or compensating for any misalignment between the components.

SUMMARY

The exemplary jack screw connector disclosed and discussed herein provides a flexible connection that accommodates lateral movement or misalignment between the lifting or jack screws and the moving components, drive mechanisms, etc. of the vehicle lift equipment. The exemplary jack screw connector is configured to transmit high axial loads in combination with a torque load to the lifting or jack screws which, in turn, actuate a lifting frame to raise the vehicle.

In one embodiment, a lifting bracket assembly system is disclosed. The lifting bracket assembly includes a motor, a pair of gear heads mechanically coupled to the motor such that each of the gear heads is coupled to a jack screw connector, a first and second jack screw, wherein each of the jack screws is coupled to one of the jack screw connectors and one of the gear heads, a first lifting bracket rotatably coupled to the first jack screw, a second lifting bracket rotatably coupled to the second jack screw, wherein the first and second jacks screws are different, a first guide tube fixedly coupled at a first end to the first lifting bracket and coupled to a first rail beam at a second end, and a second guide tube fixedly coupled at a first end to the second lifting bracket and coupled to a second rail beam at a second end.

A method for assembling a lifting bracket assembly is also disclosed. The lifting bracket assembly including a frame, a guide bracket supported by the frame, a jackscrew connected to a jackscrew connector and gearhead, with the gearhead connected to the frame. A lifting bracket is aligned and rotatably coupled to the jack screw. A guide tube is slidably aligned with a guide bracket. The guide tube has a first end and a second end opposite the first end for supporting a beam. The guide tube is aligned and fixedly connected at the first end to the lifting bracket.

Additional features and advantages of the disclosed embodiments are described in, and will be apparent from, the following Detailed Description and the figures.

DETAILED DESCRIPTION

An exemplary jack screw connector disclosed and discussed herein provides a flexible connection that accommodates lateral movement or misalignment between the lifting or jack screws and the moving components, drive mechanisms, etc. of the vehicle lift equipment. The exemplary jack screw connector is configured to transmit high axial loads in combination with a torque load to the lifting or jack screws which, in turn, actuate a lifting frame to raise the vehicle.

One embodiment of an exemplary jack screw connector may be designed and configured to support, for example, a tensile load of eighteen thousand pounds (18,000 lbs.) and may include a female threaded connector to engage or cooperate with two and seven-eighths inch (2⅞") diameter threads of a lifting or jack screw. Another embodiment of an exemplary jack screw connector may further include opposite the threaded female connector, a bore for supporting a keyed rod for coupling to a gearbox. Another embodiment of an exemplary jack screw connector may further be coated utilizing a wear resistant and/or lubricating coating such as, for example, a MICROLON® 1052 coating provided by Mircosurface Corporation of Morris, Ill.

Figure 1:
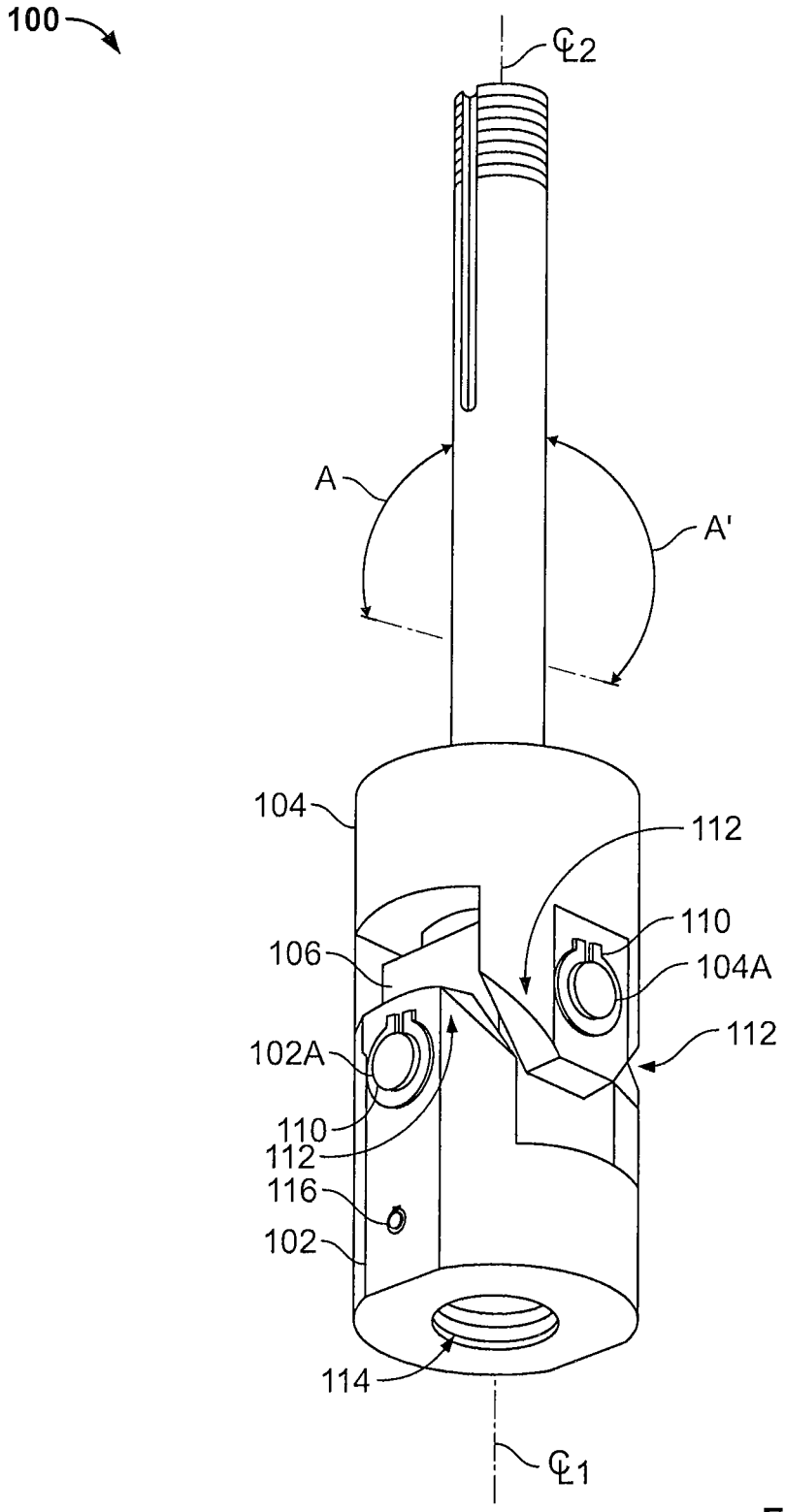
FIG. 1 illustrates a perspective view of an exemplary jack screw connector.
Figure 2:
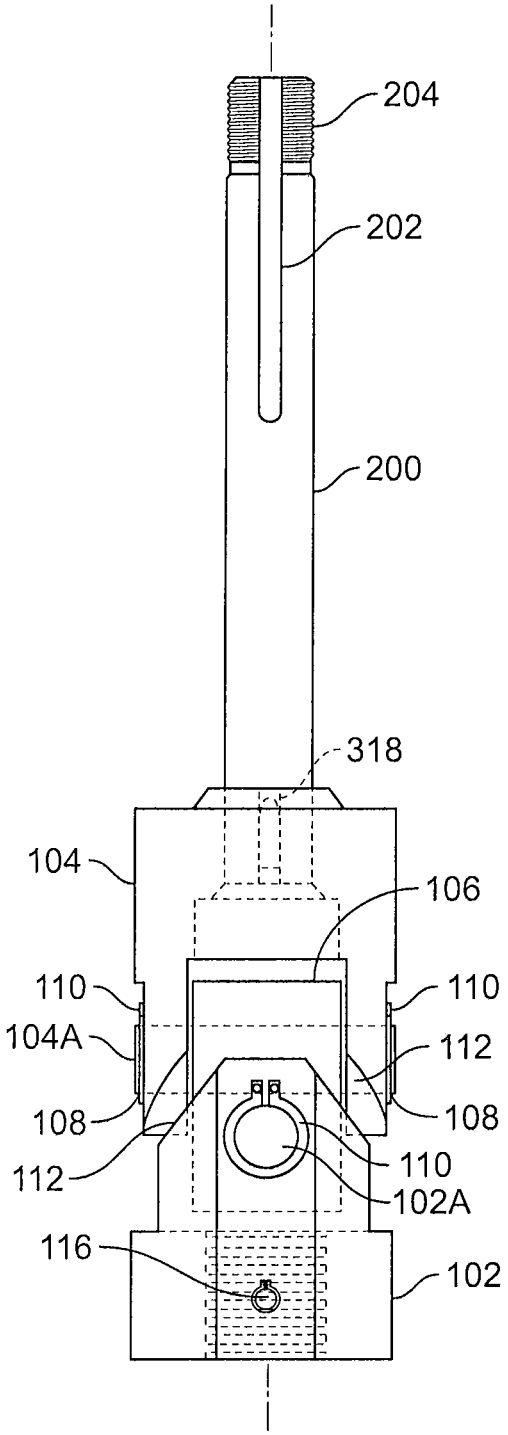
FIG. 2 illustrates a side view of the exemplary jack screw connector shown in FIG. 1.

FIG. 1 illustrates a perspective view of an exemplary jack screw connector 100. The jack screw connector 100 includes a lower connector or clevis 102 and an upper connector or clevis 104 pivotably connected to or cooperating with an eye block 106. As used herein, the term connector or clevis describes a substantially U-shaped component configured or adapted to pivotably cooperate with the eye block 106. The eye block 106 supports a pair of orthogonally or transversely oriented, with respect to each other, shafts or pins 102A and 104A pivotably coupled to the clevises 102, 104, respectively. The pins 102A and 104A each may be formed or manufactured with a pair of snap-ring grooves 108 (see FIG. 2) sized to accept a snap-ring 110. The eye block 106 supports and reinforces each of the shafts or pins 102A and 104A carried therein as well as each leg of the U-shape portion of the clevises 102, 104 relative to the base of the U-shape. In this way, the eye block 106 may contain and/or prevent undue flexing of each of the shafts or pins 102A and 104A and minimize the torque applied to each leg of the U-shape portion of the clevises 102, 104 as a load is applied thereto.

Each connector or clevis 102, 104 includes a chamfered or angled portion 112 formed at a distal end of each leg of the U-shape relative to the base of the U-shape. The chamfered portion 112 on each of the clevises 102, 104 ensures or allows for an adequate range of motion without contact relative to each of the clevises 102, 104. The combination and freedom of movement afforded between the pivotably coupled to clevises 102, 104 provides for or allows for a connection to be established and rotatably maintained between a shaft (not shown) coupled along the rotational axis CL1 associated with the lower clevis 102, and a device (not shown) coupled along the rotational axis CL2 associated with the upper clevis 104.

Figure 4:
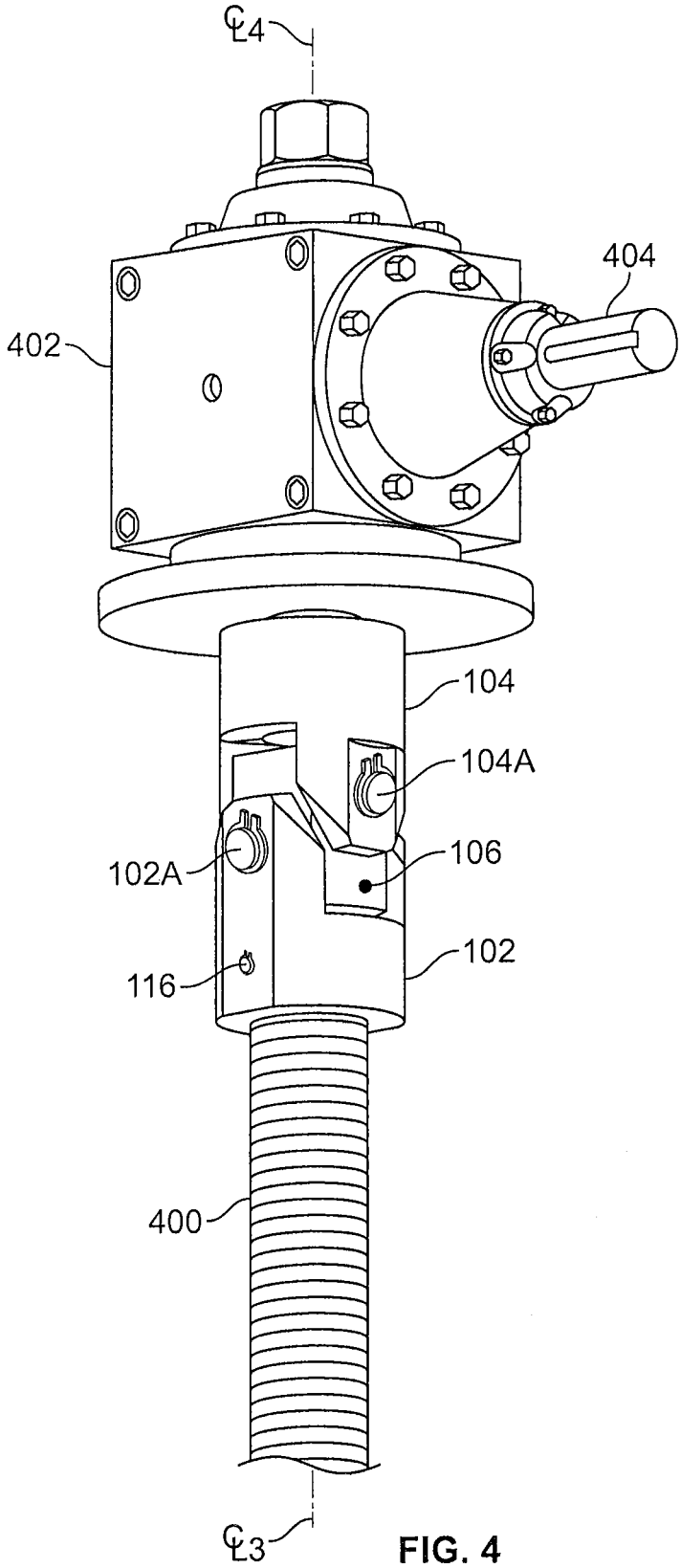
FIG. 4 illustrates an assembled perspective view of the exemplary jack screw connector coupled to a jack screw and gear box.

The lower clevis 102 may support a female threaded portion 114 for connecting to a jack screw 400 (see FIG. 4). The upper clevis 104 may include or cooperate with a load bolt 200 (see FIG. 2) having a keyed portion 202 and a threaded portion 204. The load bolt 200 may be configured to cooperate with a gear box 402 (see FIG. 4) and convey a load between the lower and upper clevises 102, 104. A locking pin 116 may be bored through the lower clevis 102 and configured to engage and secure the jack screw 400 when cooperating with the female threaded portion 114. In an alternate embodiment, the locking pin 116 may be replaced with a set screw (not shown). The set screw (not shown) may cooperate with a tapped through hole provided in the lower clevis 102. The set screw (not shown) may be arranged to engage and secure the jack screw 400 and/or a tapped hole (not shown) provided within the jack screw 400.

Figure 3:
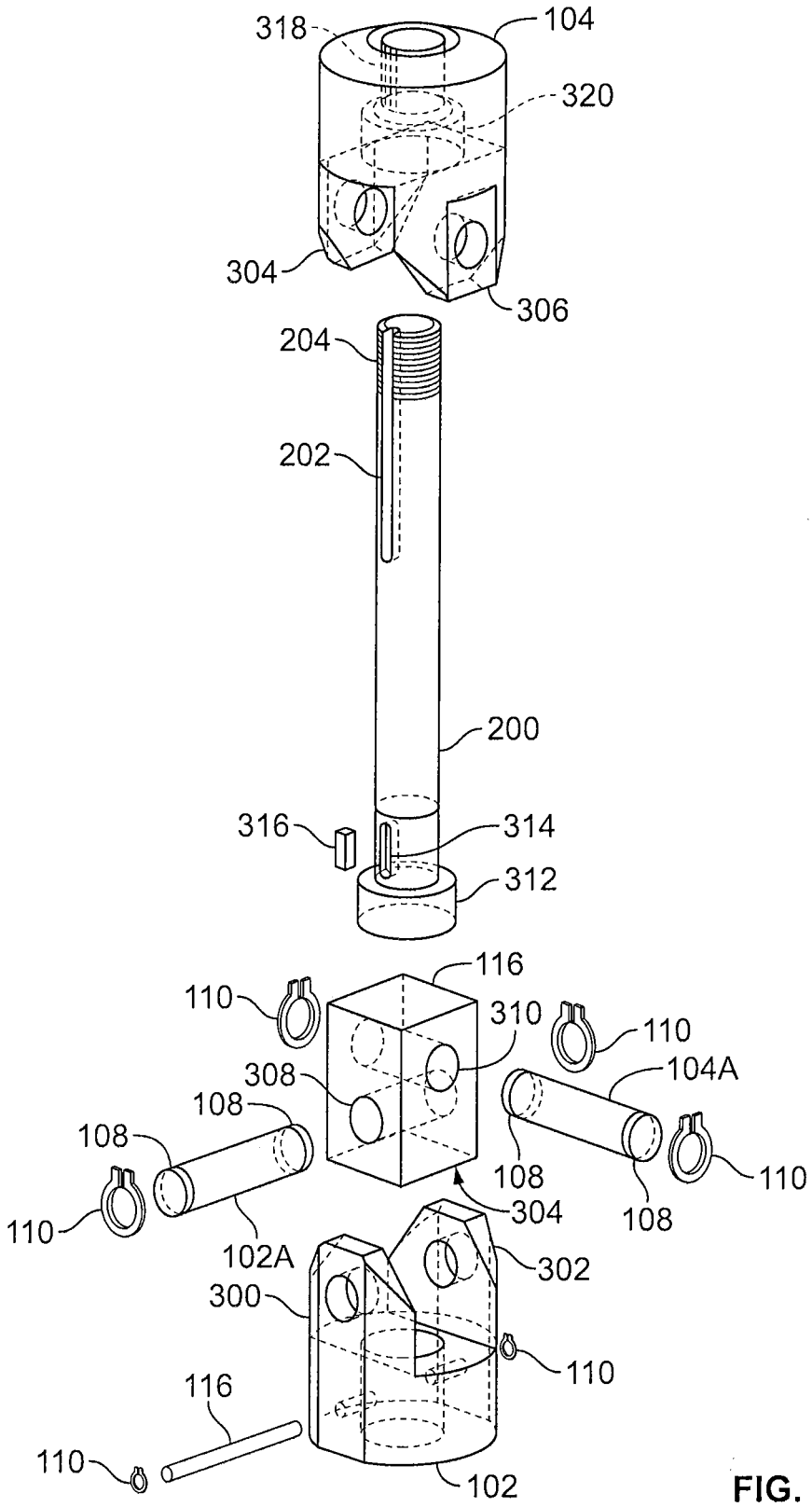
FIG. 3 illustrates an exploded perspective view of the exemplary jack screw connector shown in FIG. 1.

FIG. 3 illustrates an exploded perspective view of the exemplary jack screw connector 100. The lower clevis 102 supports and carries the eye block 106 between the legs 300, 302 that define the U-shape. The eye block 106 is sized such that the legs 300, 302 of the lower clevis 102 and the legs 304, 306 are slidable and pivotable relative to the outer surfaces of the eye block 106 while supporting the pins 102A and 104A carried within the orthogonally oriented through-bores 308, 310, respectively. The surface of the through-bores 308, 310, the surface of the pins 102A and 104A and any other surface that may experience friction, can be coated with, for example, a 0.0007" MICROLON® 1052 coating to reduce frictional wear thereon.

The load bolt 200 may include a load bolt head 312 formed distal to the threaded portion 204. A keyway 314 sized to accept a substantially rectangular key 316 may be formed adjacent to the load bolt head 312. The key 316 may be accepted within a mating keyway 318 formed in the upper clevis 104. The load bolt head 312, the keyway 314 and key 316 may cooperate with a countersunk portion 320 formed in the upper clevis 104.

FIG. 4 illustrates an assembled perspective view of the exemplary jack screw connector 100 coupled to the jack screw 400 and the gear box 402. In particular, the load bolt 200 is aligned and carried within the gear box 402 via a key (not shown) carried within the keyway 202 and a complimentary keyway (not shown) disposed within the interior of the gear box 402. In operation, the gear box 402 may be positioned such that axes $CL_3$ and $CL_4$ are substantially aligned. Any misalignment between the axis $CL_3$ and the axis $CL_4$ can be compensated for by the cooperation of the lower and upper clevises 102, 104 about the eye block 106. In this way, a rotary input provided by an input shaft 404 may be converted and supplied by the gear box 402 to the jack screw 400.

Figure 5:
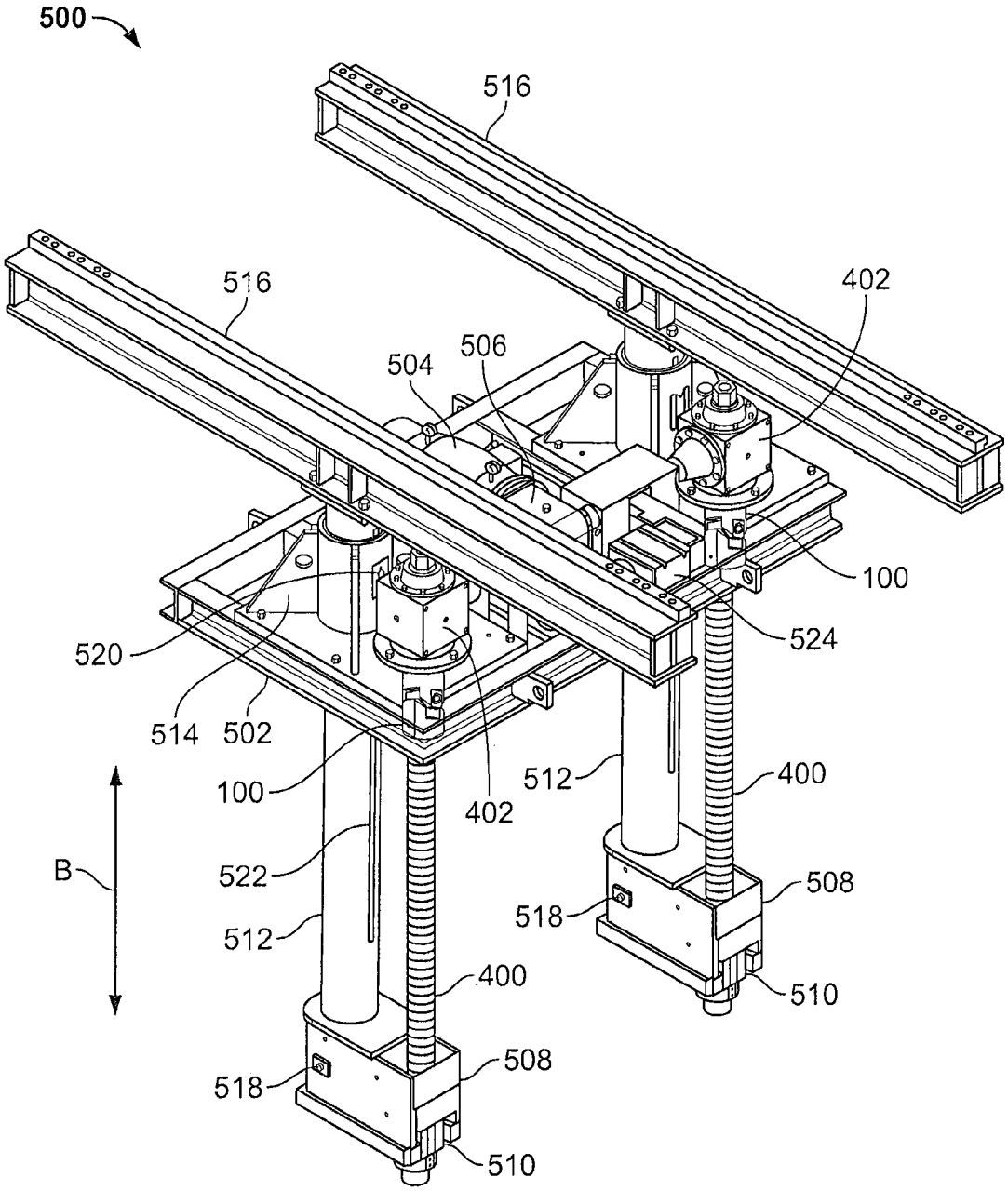
FIG. 5 illustrates an exemplary lifting bracket assembly and jack screw connector.

FIG. 5 illustrates an isometric view of a lifting bracket assembly 500 including the jack screw connector 100. In this embodiment, the jack screw connector 100 is supported and carried by a base frame 502 via the gear box 402. The base frame 502 further supports a drive motor 504 mechanically coupled to the input shaft 404 via a gear head 506. The gear head 506 may be any known reduction gear, transmission or other mechanism coupling device. The jack screw connector 100 further cooperates with a lifting bracket 508 via the jack screw 400. In particular, a jack nut 510 cooperates with the lifting bracket 508 to rotatably secure the jack screw 400. The lifting bracket 508 may, in turn, be pinned or otherwise fixedly secured to a guide tube 512. The guide tube 512 is received and guided by a guide bracket 514 secured to the base frame 502. The guide tube 512 is further secured via a pin 518 to and configured to lift a rail beam 516. For example, the guide bracket 514 may carry a key 520 sized to slideably cooperate with a keyway 522 formed in the guide tube 512. In this way, alignment between the guide bracket 514 and the guide tube 512 may be maintained. The rail beam 516 may configured to support and carry a rail car (not shown) as it is lifted or lowered in the directions indicated by the arrow B.

The lifting bracket assembly 500 shown in FIG. 5 utilizes a pair of guide tubes 512 in one embodiment. The illustrated two-guide post lifting bracket assembly 500 provides a compact design and a limited number of components. Alternatively, another embodiment may include four-guide post lifting bracket assembly (not shown) may provide for increased stability over the two-guide post lifting bracket assembly 500 while being configured to lift and support a greater load.

Figure 6:
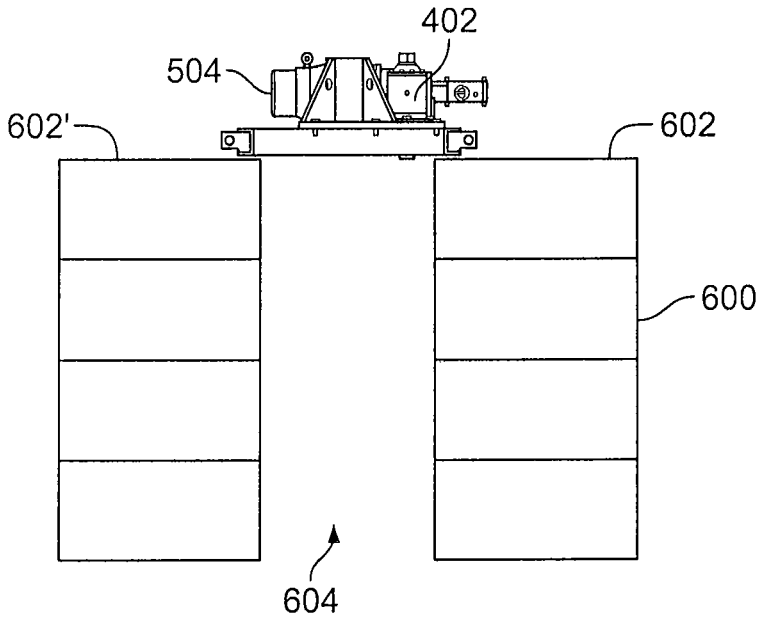
FIGS. 6 to 10 illustrate assembly drawings of the exemplary lifting bracket assembly shown in FIG. 5.
Figure 7:
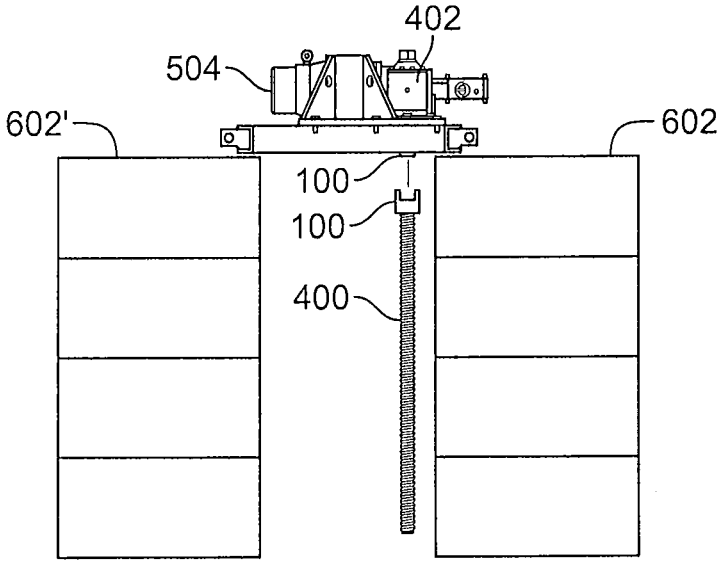
Figure 8:
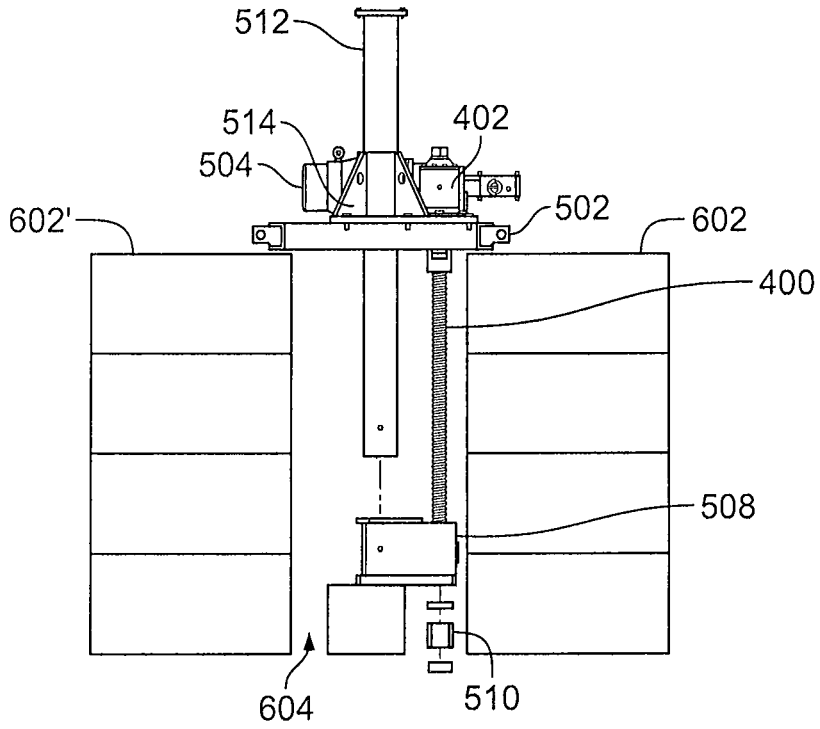
Figure 9:
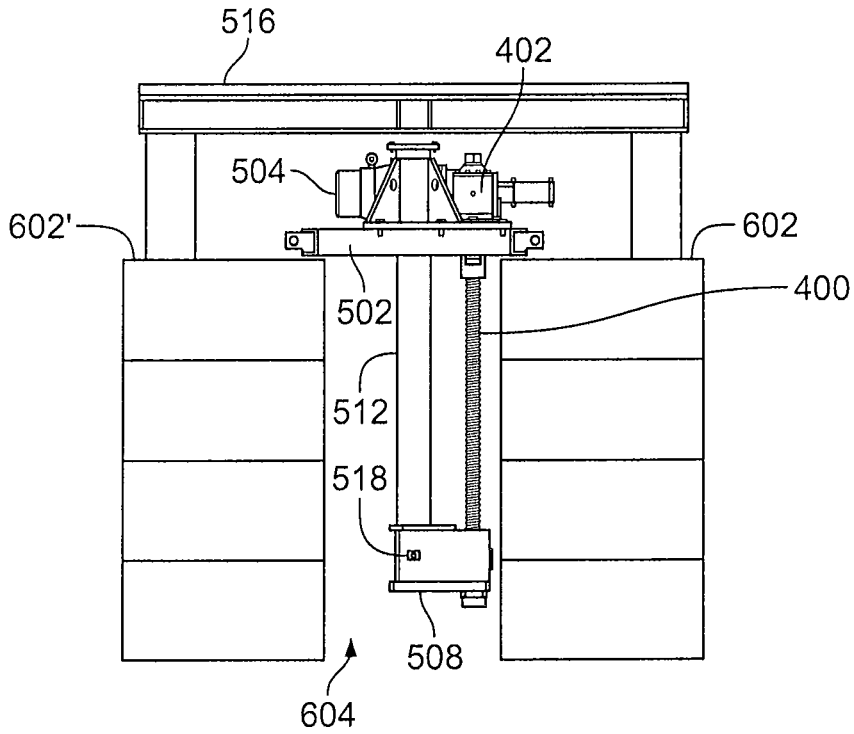
Figure 10:
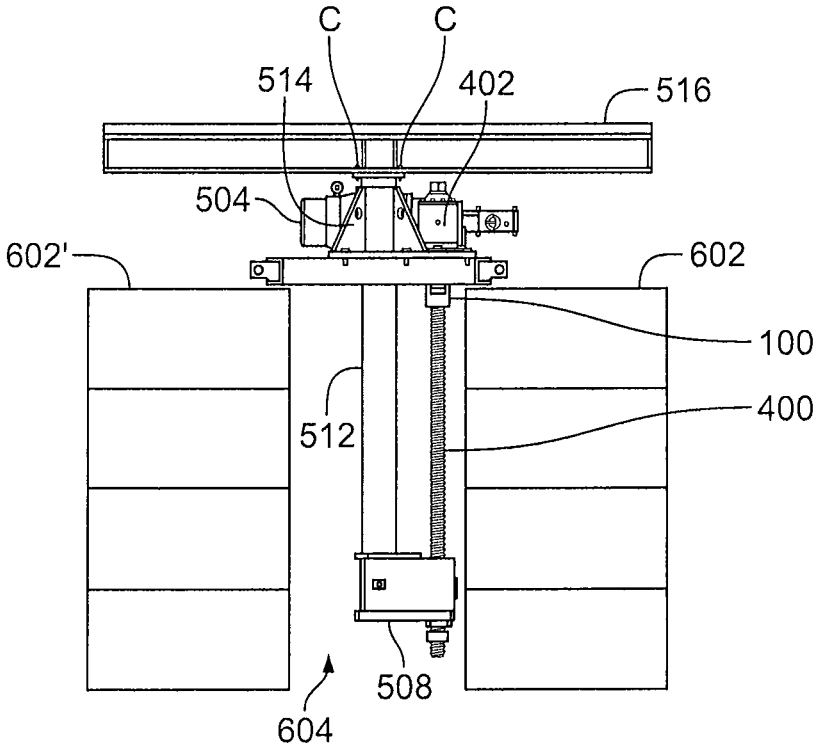

FIGS. 6 to 10 illustrate step by step assembly drawings for the lifting bracket assembly 500. FIG. 6 illustrates the base frame 502 (including the drive motor 504 and gear head 506) mounted to a test stand 600. In another embodiment, the test stand 600 may be replaced by working surfaces 602, 602' defined adjacent to a trench or circular caissons 604 dug into, for example, a rail car service facility. The base frame 502 may be positioned across the trench 604 and supported by the working surfaces 602,602'. FIG. 7 illustrates the jack screw 400 aligned for coupling to the gear box 402 via the jack screw connector 100. FIG. 8 illustrates the jack screw 400 aligned for securing to the lifting bracket 508 via the jack nut 510. The lifting bracket 508, in this exemplary embodiment, is aligned to receive the guide tube 512. The guide tube 512 is further aligned with the lifting bracket 508 utilizing the guide bracket 514 carried by the base frame 502. When the guide tube 512 engages and cooperates with the lifting bracket 508 (see FIG. 8), the pin 518 may secure the two components together. The guide tube 512, when aligned with lifting bracket 508 via the guide bracket 514, may further align with the rail beam 516. FIG. 9 illustrates the guide tube 512 secured or coupled to the rail beam 516 utilizing fasteners or bolts C.

Figure 11:
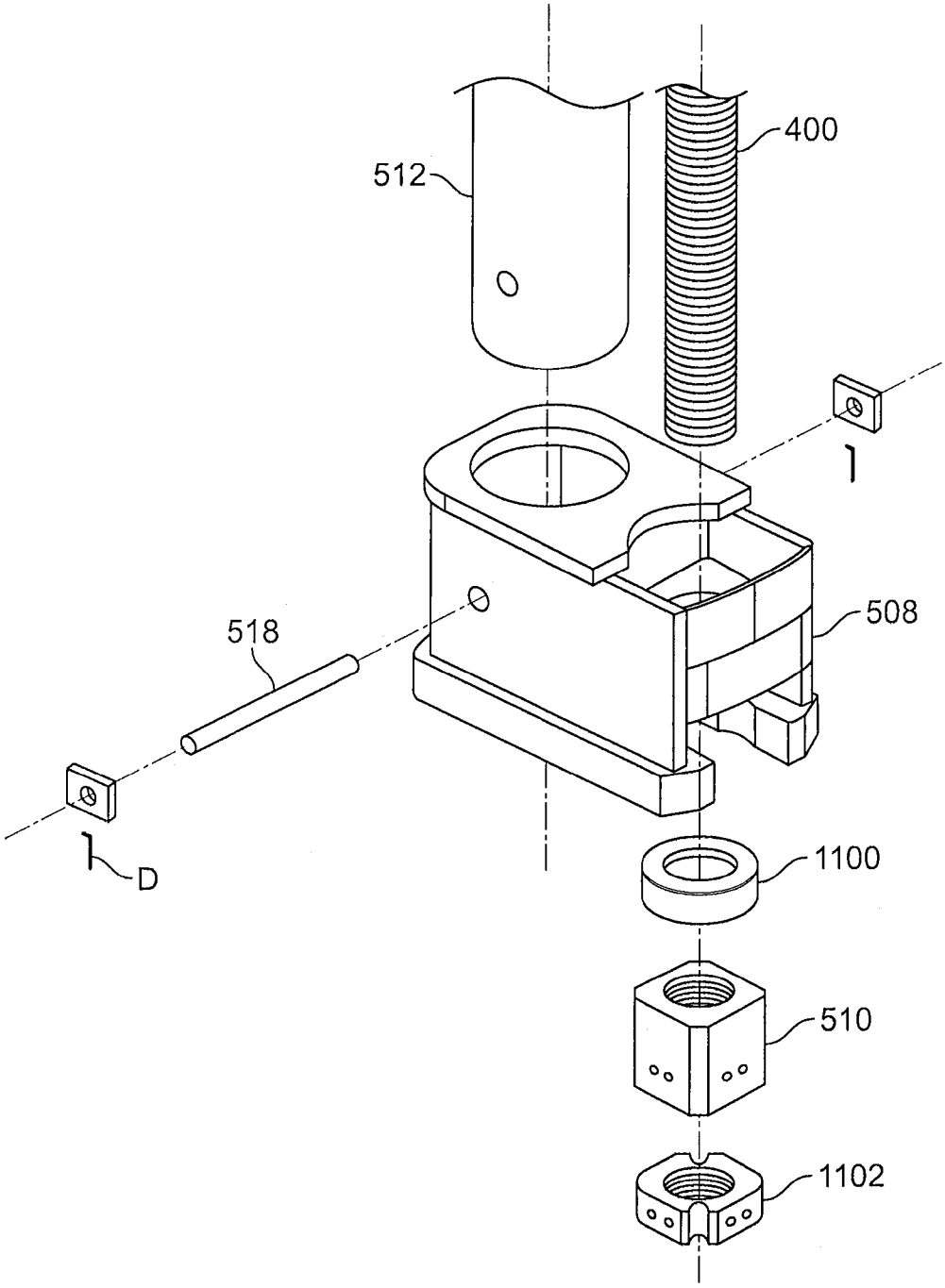
FIG. 11 illustrates an exploded view of a lifting bracket sub-assembly.

FIG. 11 illustrates an exploded perspective view of the lifting bracket 508 aligned with, and configured to engage, the jack screw 400 and the guide tube 512. The lifting bracket 508 may be a solid welded structure configured to support and receive the jack screw 400. The jack nut 510 may further cooperate with a thrust bearing 1100 and a follower nut 1102 to allow the jack screw 400 to rotate freely relative to the lifting bracket 508. The pin 518 may secure the guide tube 512 to the lifting bracket 508 utilizing one or more cotter pins D.

In operation, the motor 504 may cause the gear box 402 to rotate jack screw 400. The jack screw 400 may, in turn, rotate with respect to the lifting bracket 508. The lifting bracket 508 rides along the jack screw 400 in the direction indicated by the arrow B in FIG. 5. Because the lifting bracket 508 and the guide tube 512 are fixedly attached to each other, the movement of the lifting bracket 508 along the jack screw 400 will also cause the guide tube 512 to move in the direction indicated by the arrow B. The guide tube 512 engages and supports the beam rail 516 to raise or lower a rail car supported thereon.

In another embodiment, the lifting bracket assembly 500 may include one or more limit switches 524 configured to detect and communicate the position of the assembly 500. In yet another embodiment, a limit switch may be affixed to, for example, the base frame 502 via a wire. The wire may be part of spring loaded mechanism configured to physically and/or mechanically link base frame 502 to the lifting bracket 508. The wire or lanyard may be kept under constant tension by the spring loaded mechanism and the limit switch may be configured to detect the wire itself or a flag attached thereto. In normal operation, the limit switch may detect and verify the presence of the wire or flag. In the event of a failure such as, for example, a break in one of the jack screws 400, the lifting bracket 508 would move freely relative to the frame base 502. The uncontrolled or free movement would, in turn, separate the wire causing the limit switch to change state. The change in state may be utilized to stop and/or shut down the lifting bracket assembly 500.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims

What is claimed is:

1. A lifting bracket assembly system, comprising:

a motor;

a pair of gear heads mechanically coupled to the motor, wherein each of the gear heads is coupled to a jack screw connector;

a first and second jack screw, wherein each of the jack screws is coupled to one of the jack screw connectors;

a first lifting bracket rotatably coupled to the first jack screw; a second lifting bracket rotatably coupled to the second jack screw, wherein the first and second jack screws are different;

a first guide tube fixedly coupled at a first end to the first lifting bracket and coupled to a first rail beam at a second end; and a second guide tube fixedly coupled at a first end to the second lifting bracket and coupled to a second rail beam at a second end;

wherein at least one of the first and second jack screw connectors further comprises a pair of clevises, and a guide block coupled to each of the clevises by fasteners orthogonally oriented with respect to each other.

2. The lifting bracket assembly system of claim 1, further comprising a keyway on each of the first guide tube and the second guide tube, extending from each of the second ends.

3. The lifting bracket assembly system of claim 2, further comprising:

a first guide bracket that slidably engages with the first guide tube, wherein the first guide bracket includes a first guide bracket key;

a second guide bracket that slidably engages with the second guide tube, wherein the second guide bracket includes a second guide bracket key;

wherein the first and second guide bracket keys slidably engage with the keyways of the first and second guide tubes.

4. The lifting bracket assembly system of claim 3, wherein at least one of the first and second guide brackets further comprises a channel for receiving the guide tube.

5. The lifting bracket assembly system of claim 1 further comprising at least one positional switch physically linked to the first and second lifting brackets.

6. The lifting bracket assembly system of claim 1, wherein at least one of the first and second lifting brackets further comprises:

a cavity for receiving the first end of the guide tube; and a jack nut for rotatably coupling one of the first and second jack screws.

7. A lifting bracket assembly, comprising:

a frame;

a motor supported by the frame;

at least one drive transmission system coupled to the motor;

at least one jack screw connector coupled with one of the drive transmissions;

at least one jack screw coupled to one of the jack screw connectors;

at least one lifting bracket rotatably coupled to one of the jack screws;

at least one guide tube fixedly coupled at a first end to one of the lifting brackets and slidably engaged at a second end with a guide bracket on the frame;

wherein the jack screw connector further comprises a pair of clevises, and a guide block coupled to each of the clevises by fasteners orthogonally oriented with respect to each other.

8. The lifting bracket assembly of claim 7, further comprising a keyway on the guide tube extending from an end distal to the first end and a guide bracket key located on the guide bracket, wherein the key slidably engages with the keyway.

9. The lifting bracket assembly of claim 7 further comprising at least one positional switch located on the frame, wherein the positional switch physically links the frame to the lifting bracket.

10. The lifting bracket assembly of claim 7, wherein the guide bracket further comprises a channel for receiving the guide tube.

11. The lifting bracket assembly of claim 7, wherein the lifting bracket further comprises: a cavity for receiving the first end of the guide tube; and a jack nut for rotatably coupling the jack screw.

12. A method for assembling a lifting bracket assembly, the lifting bracket assembly including a frame, a guide bracket supported by the frame, a jackscrew connected to a jackscrew connector and gearhead, the gearhead connected to the frame, comprising:

coupling a pair of clevises and a guide block using fasteners orthogonally oriented with respect to each other to form the jackscrew connector;

aligning and rotatably coupling a lifting bracket to the jack screw;

slidably aligning a guide tube with a guide bracket, the guide tube having a first end and a second end opposite the first end for supporting a beam; and aligning and fixedly connecting the guide tube at the first end to the lifting bracket.

13. The method of claim 12, wherein aligning and rotatably coupling a lifting bracket to the jack screw further comprises rotatably securing the lifting bracket to the jack screw with a jack nut.

14. The method of claim 12, wherein slidably aligning a guide tube with a guide bracket, further comprises: aligning and slidably engaging a guide bracket key located on the guide bracket with a keyway on the guide tube extending from an end distal to the first end.

15. The method of claim 12, wherein aligning and fixedly connecting the guide tube at the first end to the lifting bracket further comprises: receiving the first end of the guide tube in a cavity in the lifting bracket; and securing the first end of the guide tube to the lifting bracket.

16. The method of claim 12, further comprising physically linking the frame to the lifting bracket with a position switch.

* * * * *